US006155801A

United States Patent [19]

Elnar

[11] Patent Number: 6,155,801

[45] Date of Patent: Dec. 5, 2000

[54] AIR BLOWER ASSEMBLY FOR SPAS

[76] Inventor: Joseph G. Elnar, 40142 Ravenwood Dr., Murrieta, Calif. 92562

[21] Appl. No.: 09/271,702

[22] Filed: Mar. 18, 1999

[51] Int. Cl.[7] ..... F04B 17/00; F04B 35/00

[52] U.S. Cl. ..... 417/363; 417/423.15; 417/377

[58] Field of Search ..... 417/363, 423.1, 417/312, 423.15; 15/377, 326, 417

[56] References Cited

U.S. PATENT DOCUMENTS

| | | | |
|---|---|---|---|
| 4,950,133 | 8/1990 | Sargent | 417/312 |
| 5,068,555 | 11/1991 | Oberdorfer-Bogel | 310/52 |
| 5,391,064 | 2/1995 | Lopez | 417/423.14 |

*Primary Examiner*—Teresa Walberg
*Assistant Examiner*—Thor Campbell
*Attorney, Agent, or Firm*—Edgar W. Averill, Jr.

[57] ABSTRACT

An air blower assembly for use with spas having a blower-and-motor unit snugly mounted inside an intake housing using a pair of ring-shaped elastomeric gaskets. An outlet housing having a smaller diameter than the intake housing but larger than the motor portion of the blower-and-motor unit, is telescopically positioned inside the intake housing and around the motor portion of the blower-and-motor unit to doubly enclose the motor portion. A muffler, having a muffler inlet port leading directly to a concave air dam, covers an air inlet port on the intake housing to block a straight-line path to the air inlet port.

13 Claims, 3 Drawing Sheets

AIR BLOWER ASSEMBLY FOR SPAS

BACKGROUND OF THE INVENTION

The field of the invention generally pertains to air blower assemblies. The invention relates more particularly to air blower assemblies used with spas having vibration-dampening elastomeric gaskets for mounting the blower-and-motor units, and a muffler member for reducing air intake noise.

Air blower assemblies have commonly been used with spas to force compressed air through numerous small apertures in the wall of a spa tub, below the water level, thereby creating a bubbling effect in the water. This creates a relaxing environment which enhances the bathing experience.

Perhaps the greatest disadvantage of air blower assemblies, however, is the noise associated with the blower-and-motor units used to pump the compressed air into the water-filled spa tubs. The noise is primarily attributable to the high speeds and noise-producing vibration generated by the blower-and-motor units. Additionally, air rushing directly into the air blower assembly during air induction creates a typically high-pitched whine. Both sources of noise can disturb and detract away from the relaxing atmosphere of the spa.

Various methods have been developed to reduce the noise created by air blower assemblies used with spas. One method has been to line the internal surface of the structure enclosing the blower-and-motor unit with sound-insulating material. In U.S. Pat. No. 4,950,133 an air blower assembly is shown having an inverted cup-shaped cover fitted over the open side of a cup-shaped base to define an enclosed air chamber above a blower-and-motor unit mounted in the cup-shaped base. An elongated air passage defined by the cup-shaped base leads air into the enclosed air chamber from an air inlet port. Both the enclosed air chamber and the elongated air passage are lined extensively with acoustical foam.

This method, however, can make the air blower assembly excessively bulky, resulting from the concentric placement of the acoustical foam lining in relation to the elongated air passage used for air induction. As can be best seen in FIG. 4 and FIG. 6 of U.S. Pat. No. 4,950,133, this arrangement increases the diameter of the air blower assembly considerably. As shown in FIG. 6, the elongated inlet passages, indicated by reference characters 50, 51, and 52, form an additional concentric layer surrounding the blocks of acoustic foam material, indicated by reference characters 67, 68, and 69.

Additionally, various methods of mounting the blower-and-motor units have been used to reduce noise-producing vibration generated by air blower assemblies. In U.S. Pat. No. 4,950,133, discussed above, the air blower assembly has a blower-and-motor unit centrally mounted on a platform portion of a cup-shaped base by means of an acoustical foam nest. The acoustical foam nest rests inside the platform portion supporting only the enlarged blower portion of the blower-and-motor unit, with the attached motor portion extending through a central opening of the platform portion. A strap secures the blower-and-motor unit to the acoustical foam nest and the cup-shaped base. Another example is shown in U.S. Pat. No. 5,068,555 disclosing a dust exhauster. The dust exhauster has a commutatorless D.C. electric motor/turbine unit which is mounted between a lower support plate and an upper anchoring plate using rubber elements.

The existing mounting methods, however, have been largely inadequate in dampening the noise-producing vibration generated by blower-and-motor units. The mounts used in the prior disclosures are molded to contour exactly to the surface of both the blower-and-motor units and the mounting surfaces, typically a housing structure. Complete surface-to-surface contact can improve transfer, not dampening, of vibration from the blower-and-motor unit to the enclosing housing structure.

BRIEF SUMMARY OF THE INVENTION

It is an object of the present invention to provide an improved air blower assembly for spas which operates quieter than prior air blower assemblies without the extensive use of sound-insulating materials.

The present invention is for a quieter air blower assembly for use with spas, which effectively reduces noise generated by a blower-and-motor unit without the extensive use of sound-insulating materials. Ribbed elastomeric gaskets are used to snugly mount the blower-and-motor unit inside a bucket-shaped intake housing having an air inlet port at an intake endwall. Noise reduction is partly accomplished by the ribbed elastomeric gaskets which function to dampen noise-producing vibration generated by the blower-and-motor unit. A bucket-shaped outlet housing having an open end, an outlet port at an outlet endwall, and an outlet sidewall having a rim at the open end, encloses the open end of the intake housing. The outlet sidewall, having a diameter less than the intake housing, is telescopically positioned inside the intake sidewall and around the blower-and-motor unit. An inter-sidewall volume containing stagnant air is created between the intake sidewall and the outlet sidewall which serves as a double-walled sound-barrier to confine noise within the air blower assembly. Additionally, a muffler member is affixed to the intake housing for quieter air induction. Air inducted through a muffler intake port is directed around a concave air dam extending from a muffler endwall and blocking a straight-line sound path to the air inlet port. A layer of acoustic foam material is affixed to the concave air dam to further insulate induction noise at the air inlet port.

DETAILED DESCRIPTION OF THE PREFERRED EMBODIMENTS

Figure 1:
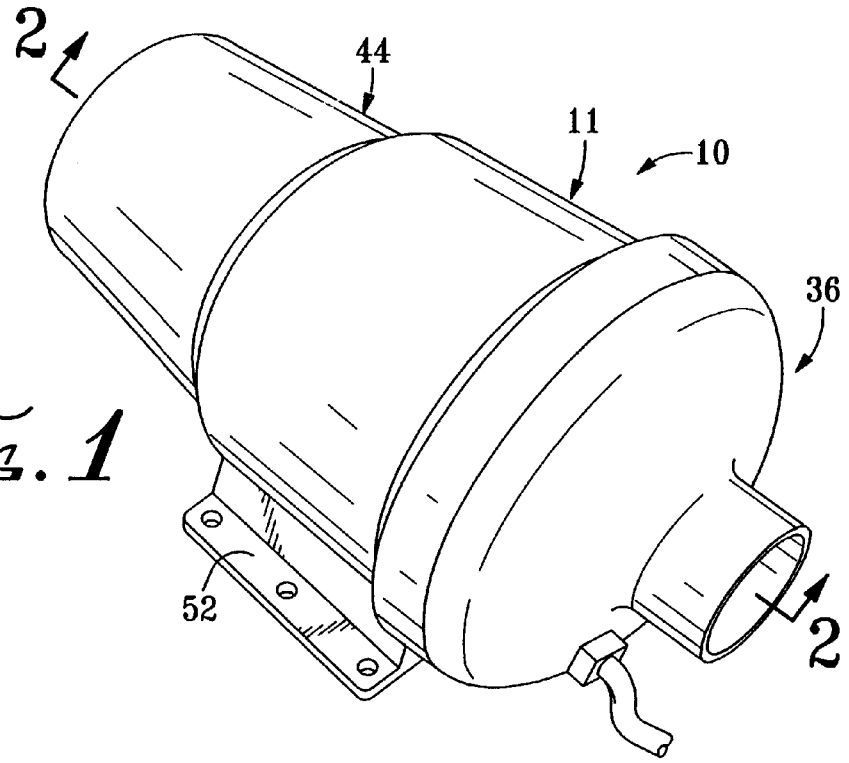
FIG. 1 is a perspective view of the air blower assembly.

Referring now to the drawings, FIG. 1 shows a perspective view of the exterior of the air blower assembly, generally indicated at 10. As can be seen in FIG. 1, the air blower assembly 10 is a compact apparatus having an intake housing, generally indicated at 11, an outlet housing, generally indicated at 36, a muffler member, generally indicated at 44, and a mounting base 52. A blower-and-motor unit shown in FIG. 2, generally indicated at 19, is snugly mounted inside the intake housing 11. Details of the air blower assembly 10 can be best seen in FIG. 2 which is a cross-sectional view of the air blower assembly 10 taken along the line of 2—2 of FIG. 1. In particular, FIG. 2 shows the compact design and organization of the air blower assembly 10 which results in significantly improved noise reduction.

Figure 2:
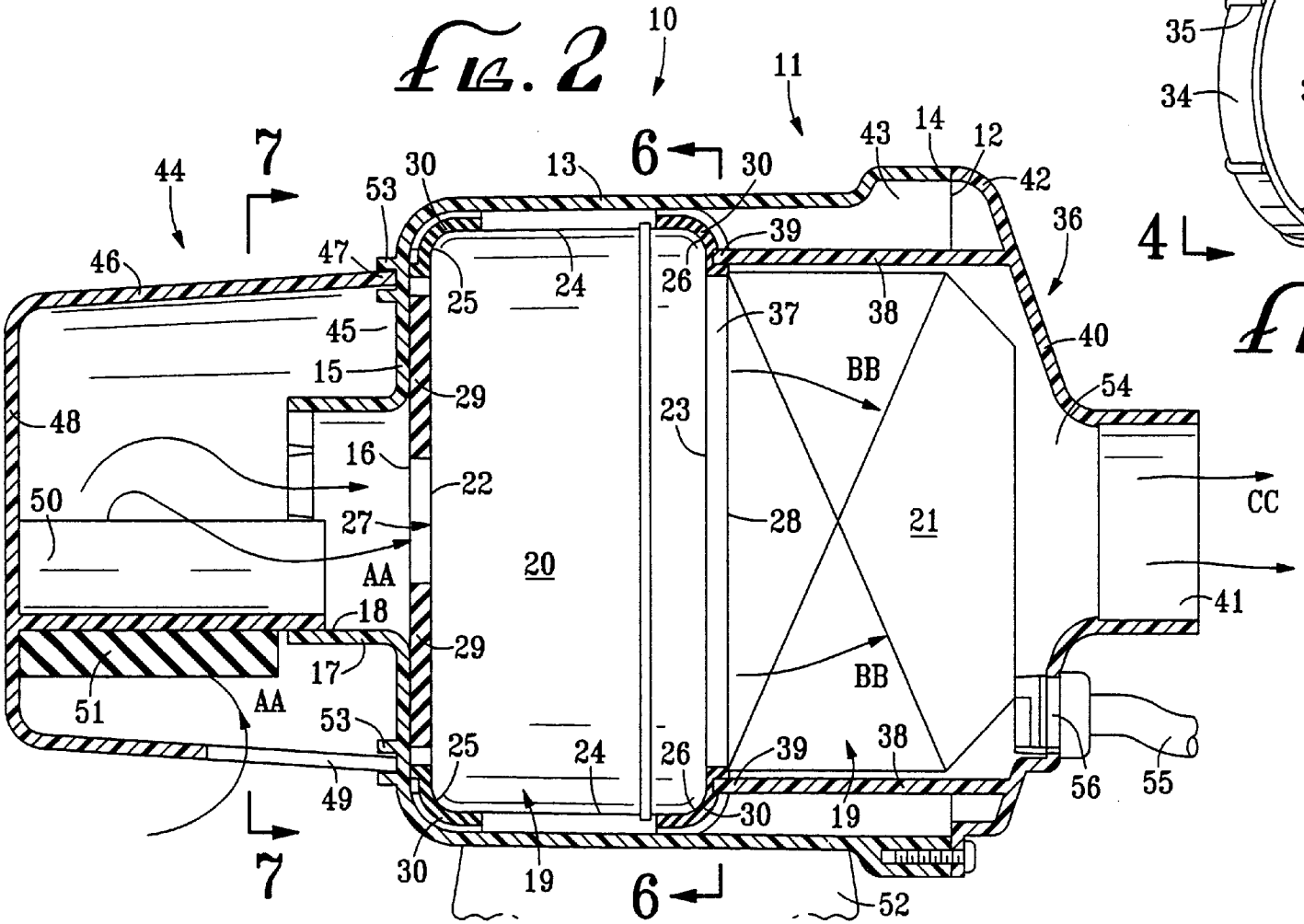
FIG. 2 is a cross-sectional view of the air blower assembly taken along the line of 2—2 of FIG. 1.

As can be seen in FIG. 2, the intake housing 11 snugly supports the blower-and-motor unit 19 inside a limited and confined space. The intake housing 11 has a generally bucket-shaped configuration with an open end 12, an intake sidewall 13 having a rim 14 at the open end 12, and an intake endwall 15 with a centrally located air inlet port 16. The air inlet port 16 is surrounded by an intake collar 17 integrally formed on an exterior surface of the intake endwall 15. The blower-and-motor unit 19 has an enlarged blower portion 20 with a generally cylindrical configuration. The enlarged blower portion 20 has an inlet end 22, an outlet end 23, and a blower sidewall 24 joining the inlet end 22 at an inlet edge 25 and the outlet end 23 at an outlet edge 26. An air inlet 27 and an air outlet 28 are centrally located on the inlet end 22 and the outlet end 23 of the enlarged blower portion 20, respectively. A layer of acoustic foam material 29 is affixed to the inlet end 22 surrounding the air inlet 27 to provide supplementary sound-insulation at the inlet end 22. The blower-and-motor unit 19 also has a motor portion 21 centrally affixed to the enlarged blower portion 20 at the outlet end 23 adjacent the air outlet 28. Only the enlarged blower portion 20, however, contacts the intake housing 11; the attached motor portion 21 remains suspended between the intake sidewall 13 adjacent the open end 12 of the intake housing 11. The enlarged blower portion 20 is snugly seated between the intake sidewall 13 and adjacent the intake endwall 15 via a pair of elastomeric gaskets 30. The pair of elastomeric gaskets 30 is positioned on the inlet edge 25 and the outlet edge 26 of the enlarged blower portion 20.

Figure 3:
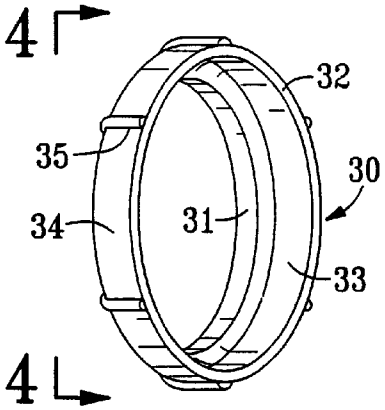
FIG. 3 is a perspective view of the elastomeric gasket.
Figure 4:
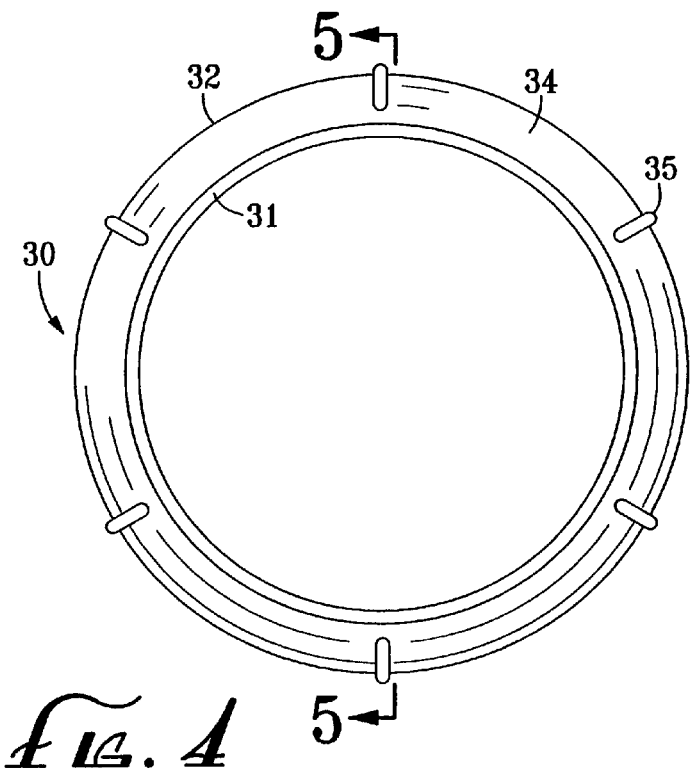
FIG. 4 is a view of the elastomeric gasket taken along the line of 4—4 of FIG. 3.
Figure 5:
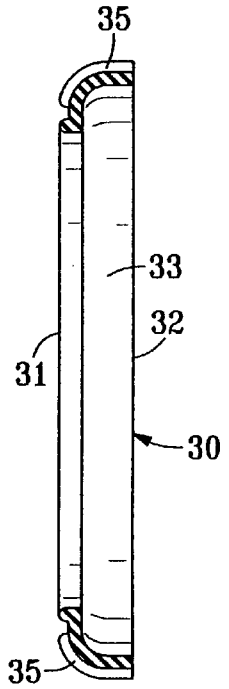
FIG. 5 is a cross-sectional view of the elastomeric gasket taken along the line of 5—5 of FIG. 4.
Figure 6:
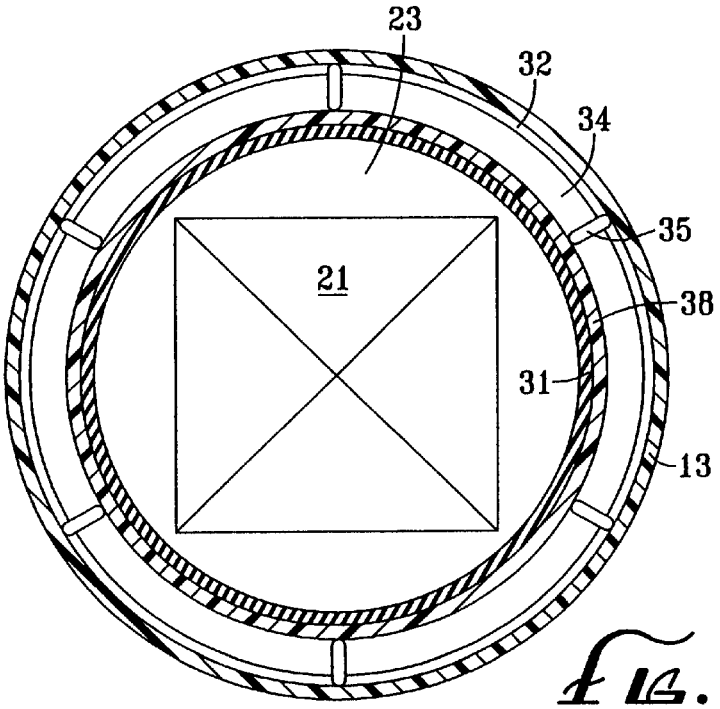
FIG. 6 is a cross-sectional view of the air blower assembly taken along the line of 6—6 of FIG. 2.

Details of an individual elastomeric gasket 30 is shown in FIGS. 3, 4, and 5. As shown in FIG. 3 and FIG. 4 each elastomeric gasket 30 has a generally ring-shaped configuration with an inner ring edge 31, an outer ring edge 32, an inner surface 33, and an outer surface 34. And as can be best seen in FIG. 3 and FIG. 5, the outer surface 34 is curved around the inner surface 33, contouring to the shape of the respective inlet edge 25 or outlet edge 26 of the enlarged blower portion 20, as shown in FIG. 2. Additionally, each elastomeric gasket 30 has at least three rib members 35, and preferably six, along its outer surface 34. Each rib member 35 is radially directed and equally spaced along the circumference of the elastomeric gasket 30. As can be seen in FIG. 6, the rib members 35 narrowly space the elastomeric gasket 30 from the intake sidewall 13. This prevents complete surface-to-surface contact between the outer surface 34 of the elastomeric gasket 30 and the intake sidewall 13. In this manner the rib members 35 help dampen noise-producing vibration from the blower-and-motor unit 19 while providing a substantial mounting support. The elastomeric gaskets 30 can be formed from any suitable elastic material capable of vibration dampening.

FIG. 2 also shows an outlet housing 36 partially positioned inside the intake housing 11 at its open end 12, and surrounding the motor portion 21 of the blower-and-motor unit 19. As can be seen in FIG. 2, the outlet housing 36 has a generally bucket-shaped configuration with an open end 37, an outlet sidewall 38 having a rim 39 at the open end 37, an outlet endwall 40 having a centrally located air outlet port 41, and an outlet volume 54 defined by the outlet sidewall 38. The outlet endwall 40 has a greater diameter than the outlet sidewall 38 to create an overhang 42. The outlet sidewall 38 has a diameter less than an average diameter of the intake sidewall 13, but greater than an average diameter of the motor portion 21 of the blower-and-motor unit 19. This enables the outlet sidewall 38 to be telescopically positioned inside the intake sidewall 13 and around the motor portion 21. An inter-sidewall volume 43 is created between the outlet sidewall 38 and the intake sidewall 13. When the overhang 42 of the outlet housing 36 is secured to the intake housing 11, the rim 39 of the outlet sidewall 38 is pressed against the elastomeric gasket 30 mounted on the outlet edge 26 of the enlarged blower unit 20. The intake sidewall 13, the outlet sidewall 38, and the inter-sidewall volume 42, in combination, form an effective sound-barrier of stagnant air which reduces the amount of noise generated by the motor portion 21 escaping beyond the air blower assembly 10. Additionally, an electric cord 55 extends into the outlet volume 54 through an integrally formed aperture 56 on the outlet endwall 40 and connects to the motor portion 21 of the blower-and-motor unit 19.

Figure 7:
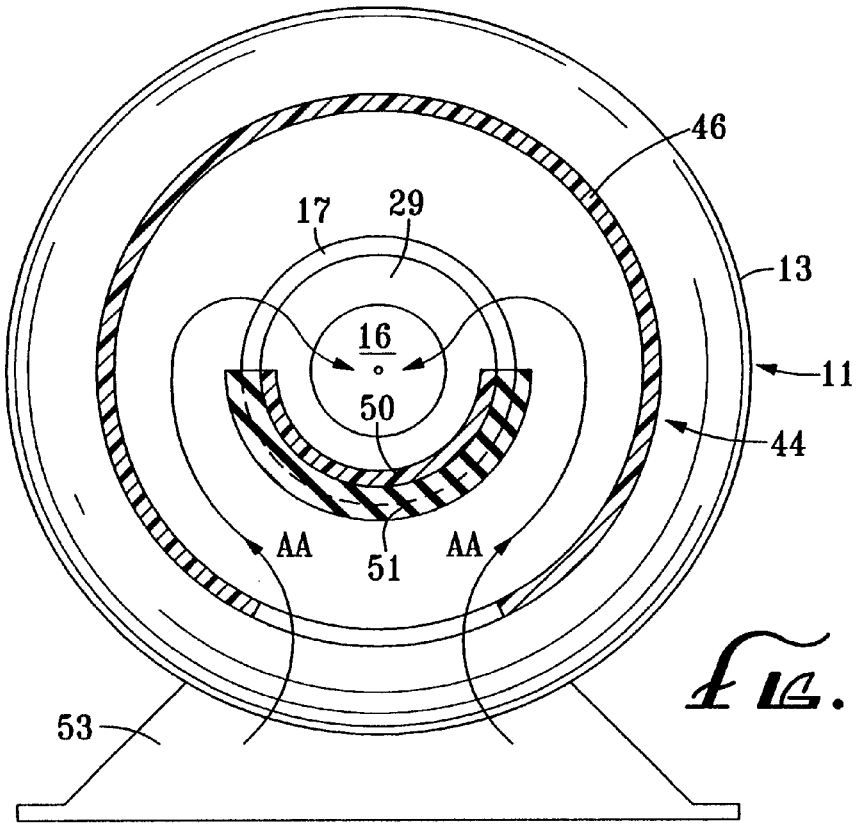
FIG. 7 is a cross-sectional view of the muffler member taken along the line of 7—7 of FIG. 2.

As can be seen in FIG. 2, the muffler member 44 is affixed to the intake endwall 15 of the intake housing 11 to reduce noise produced by air rushing into the air blower assembly 10 during induction. The muffler member 44 has a generally bucket-shaped configuration with an open end 45, a muffler sidewall 46 extending to a muffler rim 47 at the open end 45, and a muffler endwall 48 opposite the open end 45. The muffler rim 47 is snugly positioned in a circular groove 53 formed on the exterior surface of the intake endwall 15. The muffler member 44 inducts air through a muffler intake port 49 located at the muffler sidewall 46. An air dam 50 extending from the muffler endwall 48 blocks a direct path to the air inlet port 16 of the intake housing 11. The air dam 50 has a convex outer surface which faces and radially aligns with the muffler intake port 49. The air dam 50 telescopically extends partially into the intake collar 17 of the intake housing 11, contouring to an inner collar surface 18 of the intake collar 17. FIG. 7 shows the concave curvature of the air dam 50 and how it blocks a direct path to the air inlet port 16. A layer of acoustic foam material 51 is affixed to the concave surface of the air dam 50 to further muffle induction noise at the air inlet port 16. A suitable conventional screen-filter may be affixed across the muffler intake port 49 to screen out undesirable particles, such as leaves, which may obstruct the air flow.

Operation of the air blower assembly 10 inducts air through the muffler intake port 49 and expels it from the air outlet port 41 and into a connecting air hose (not shown). FIG. 2 and FIG. 7 together show the path of the air flow as it is forced through the air blower assembly 10. The air flow of the induction phase is indicated in FIG. 2 and FIG. 7 by arrows AA. The air flow of the blower-exhaust phase is indicated in FIG. 2 by arrows BB. And the air flow at the exit phase by arrows CC. During the initial induction phase AA, air is inducted through the muffler intake port 49 and directed around the air dam 50. The air is then inducted over the intake collar 17, in through the air inlet port 16 of the intake housing 11, and into the air inlet 27 of the enlarged blower portion 20 of the blower-and-motor unit 19. The air flow at the blower-exhaust phase BB constitutes moderately compressed air which flows through and past the motor portion 21 of the blower-and-motor unit 19. Because the motor portion 21 is in the path of the centrally expelled air flow at the blower-exhaust phase BB, the motor is effectively cooled in the process to sustain a long service life. Finally, at the exhaust phase CC of the air flow, the air is pumped out of the air outlet port 41 and into an air hose (not shown) leading to a spa tub.

The resulting combination of the vibration dampening features of the elastomeric gaskets 30, the double-walled sound-barrier of the inter-sidewall volume 42, and the muffler member 44, is a compact, efficient, and significantly quieter air blower assembly which greatly enhances the enjoyment of spas.

The composition of the structural/housing components of the air blower assembly 10, including the intake housing 11, the outlet housing 36, the muffler member 44, and the mounting base 52, are composed of a suitable molded plastic material.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An air blower assembly for quieter operation in spas, said air blower assembly comprising:

a blower-and-motor unit comprising a blower component having a generally cylindrical configuration with an inlet end, an outlet end, and a blower sidewall joining the inlet end at an inlet edge and the outlet end at an outlet edge, said blower component having an air inlet on the inlet end and an air outlet on the outlet end, and a motor component secured to the outlet end of the blower component for actuating the blower component to create an air stream which flows therethrough;

an intake housing having a generally bucket-shaped configuration with an open end, an intake sidewall having a rim at the open end of the intake housing, and an intake endwall opposite the open end of the intake housing, said intake endwall having an exterior surface, an air inlet port, and an intake collar formed on the exterior surface of the intake endwall which surrounds the air inlet port, said intake collar having an inner collar surface, and said blower-and-motor unit being positioned in the intake housing with the inlet end of the blower component adjacent the intake endwall;

means for mounting the blower-and-motor unit in the intake housing, said means for mounting the blower-and-motor unit having a vibration-dampening quality and positioned snugly between the blower component and the intake housing;

an outlet housing having a generally bucket-shaped configuration with an open end, an outlet sidewall having a rim at the open end of the outlet housing, an outlet endwall opposite the open end of the outlet housing having an air outlet port, and an outlet volume defined by the outlet sidewall, said outlet sidewall having a diameter less than an average diameter of the intake sidewall and telescopically positioned within the intake sidewall whereby the rim of the outlet housing sealably presses against the means for mounting the blower-and-motor unit and an inter-sidewall volume containing stagnant air is created between the intake sidewall and the outlet sidewall, and said outlet endwall having a diameter greater than an average diameter of the outlet sidewall whereby an overhang is formed, said overhang abutting against the rim of the intake housing to enclose the inter-sidewall volume.

2. An air blower assembly as in claim 1, wherein the means for mounting the blower-and-motor unit in the intake housing is a pair of elastomeric gaskets, each having a generally ring-shaped configuration with an inner surface, an outer surface, an inner ring edge, and an outer ring edge, said outer ring edge being curved around the inner surface, whereby the inner surface contours to the respective first edge and second edge of the blower component.

3. An air blower assembly as in claim 2, wherein the elastomeric gaskets each have at least three radially-directed and equally-spaced rib members on the outer surface of each elastomeric gasket, whereby the ribs space each elastomeric gasket from the intake sidewall for additionally dampening vibration.

4. An air blower assembly as in claim 1, further comprising a muffler member having a generally bucket-shaped configuration with an open end, a muffler sidewall having a muffler intake port and a rim at the open end of the muffler member attaching to the intake endwall, and a muffler endwall opposite the open end of the muffler member having an interior surface and an air dam formed on the interior surface, said air dam having a convex outer surface which faces and radially aligns with the muffler intake port and which contours to the inner collar surface of the intake collar, said air dam snugly and partially extending into the intake collar, whereby the air dam impedes direct air flow from the muffler intake port to the air inlet port for turbulently admitting air therethrough.

5. An air blower assembly as in claim 4, wherein the muffler member has an acoustical foam layer affixed to the convex outer surface of the air dam.

6. An air blower assembly as in claim 5, wherein the blower-and-motor unit has an acoustical foam layer affixed to the inlet end of the blower component.

7. An air blower assembly as in claim 6, wherein the intake end wall has a circular groove formed on the exterior surface of the intake end wall, said groove having a diameter equal to an average diameter of the rim of the muffler member, for snugly positioning the rim of the muffler member in the groove and against the exterior surface of the intake end wall.

8. An air blower assembly for quieter operation in spas, said air blower assembly comprising:

a blower-and-motor unit comprising a blower component having a generally cylindrical configuration with an inlet end, an outlet end, and a blower sidewall joining the inlet end at an inlet edge and the outlet end at an outlet edge, said blower component having an air inlet on the inlet end and an air outlet on the outlet end, and a motor component secured to the outlet end of the blower component for actuating the blower component to create an air stream which flows therethrough;

an intake housing having a generally bucket-shaped configuration with an open end, an intake sidewall having a rim at the open end of the intake housing, and an intake endwall opposite the open end of the intake housing, said intake endwall having an exterior surface, an air inlet port, and an intake collar formed on the exterior surface of the intake endwall which surrounds the air inlet port, said intake collar having an inner collar surface, and said blower-and-motor unit being positioned in the intake housing with the inlet end of the blower component adjacent the intake endwall;

means for mounting the blower-and-motor unit in the intake housing, said means for mounting the blower-and-motor unit having a vibration-absorbing quality and positioned snugly between the blower component and the intake housing, said means for mounting the blower-and-motor unit comprising a pair of elastomeric gaskets, each having a generally ring-shaped configuration with an inner surface, an outer surface, an inner ring edge, and an outer ring edge, said outer ring edge being curved around the inner surface, whereby the inner surface contours to the respective first edge and second edge of the blower component;

an outlet housing having a generally bucket-shaped configuration with an open end, an outlet sidewall having a rim at the open end of the outlet housing, an outlet endwall opposite the open end of the outlet housing having an air outlet port, and an outlet volume defined by the outlet sidewall, said outlet sidewall having a diameter less than an average diameter of the intake sidewall and telescopically positioned within the intake sidewall whereby the rim of the outlet housing sealably presses against the means for mounting the blower-and-motor unit and an inter-sidewall volume containing stagnant air is created between the intake sidewall and the outlet sidewall, and said outlet endwall having a diameter greater than an average diameter of the outlet sidewall whereby an overhang is formed, said overhang abutting against the rim of the intake housing to enclose the inter-sidewall volume.

9. An air blower assembly as in claim 8, wherein the elastomeric gaskets each have at least three radially-directed and equally-spaced rib members on the outer surface of each elastomeric gasket, whereby the ribs space each elastomeric gasket from the intake sidewall for additionally dampening vibration.

10. An air blower assembly as in claim 8, further comprising a muffler member having a generally bucket-shaped configuration with an open end, a muffler sidewall having a muffler intake port and a rim at the open end of the muffler member attaching to the intake endwall, and a muffler endwall opposite the open end of the muffler member having an interior surface and an air dam formed on the interior surface, said air dam having a convex outer surface which faces and radially aligns with the muffler intake port and which contours to the inner collar surface of the intake collar, said air dam snugly and partially extending into the intake collar, whereby the air dam impedes direct air flow from the muffler intake port to the air inlet port for turbulently admitting air therethrough.

11. An air blower assembly as in claim 10, wherein the blower-and-motor unit has an acoustical foam layer affixed to the inlet end of the blower component.

12. An air blower assembly as in claim 11, wherein the muffler member has an acoustical foam layer affixed to the convex outer surface of the air dam.

13. An air blower assembly as in claim 12, wherein the intake end wall has a circular groove formed on the exterior surface of the intake end wall, said groove having a diameter equal to an average diameter of the rim of the muffler member, for snugly positioning the rim of the muffler member in the groove and against the exterior surface of the intake end wall.

* * * * *